US006669534B2

(12) United States Patent
Shirzadi Ghoshouni et al.

(10) Patent No.: US 6,669,534 B2
(45) Date of Patent: Dec. 30, 2003

(54) SURFACE TREATMENT OF OXIDIZING MATERIALS

(76) Inventors: Amir Abbas Shirzadi Ghoshouni, c/o The Department of Material Science & Metallurgy, Pembroke Street, Cambridge CB2 3QZ (GB); Eric Robert Wallach, c/o The Department of Material Science & Metallurgy, Pembroke Street, Cambridge CB2 3QZ (GB)

( * ) Notice: Subject to any disclaimer, the term of this patent is extended or adjusted under 35 U.S.C. 154(b) by 0 days.

(21) Appl. No.: 10/205,549

(22) Filed: Jul. 26, 2002

(65) Prior Publication Data

US 2003/0022597 A1 Jan. 30, 2003

(30) Foreign Application Priority Data

Jul. 27, 2001 (GB) ..... 0118348

(51) Int. Cl.[7] ..... B24B 1/00
(52) U.S. Cl. ..... 451/28; 451/41

(58) Field of Search ..... 451/28, 7, 41, 451/53; 438/690–693; 156/345.12

(56) References Cited

U.S. PATENT DOCUMENTS 5,247,765 A * 9/1993 Quintana ..... 451/548
6,153,525 A * 11/2000 Hendricks et al. ..... 438/692
6,589,305 B1 * 7/2003 Rosenflanz ..... 51/309
6,592,640 B1 * 7/2003 Rosenflanz et al. ..... 51/309

FOREIGN PATENT DOCUMENTS

JP 11188635 A * 7/1999 ..... B24D/3/34
JP 2000144111 A * 5/2000 ..... C09K/3/14

* cited by examiner

*Primary Examiner*—Joseph J. Hail, III
*Assistant Examiner*—David B. Thomas
(74) *Attorney, Agent, or Firm*—Dykema Gossett PLLC

(57) ABSTRACT

A method for treating the surface of a material to remove an oxide layer formed thereon. The method comprising the step of grinding the surface of the material with a grinding or polishing device having a metal with a melting point of 300° C. or lower impregnated therein.

5 Claims, 1 Drawing Sheet

SURFACE TREATMENT OF OXIDIZING MATERIALS

Figure 1:
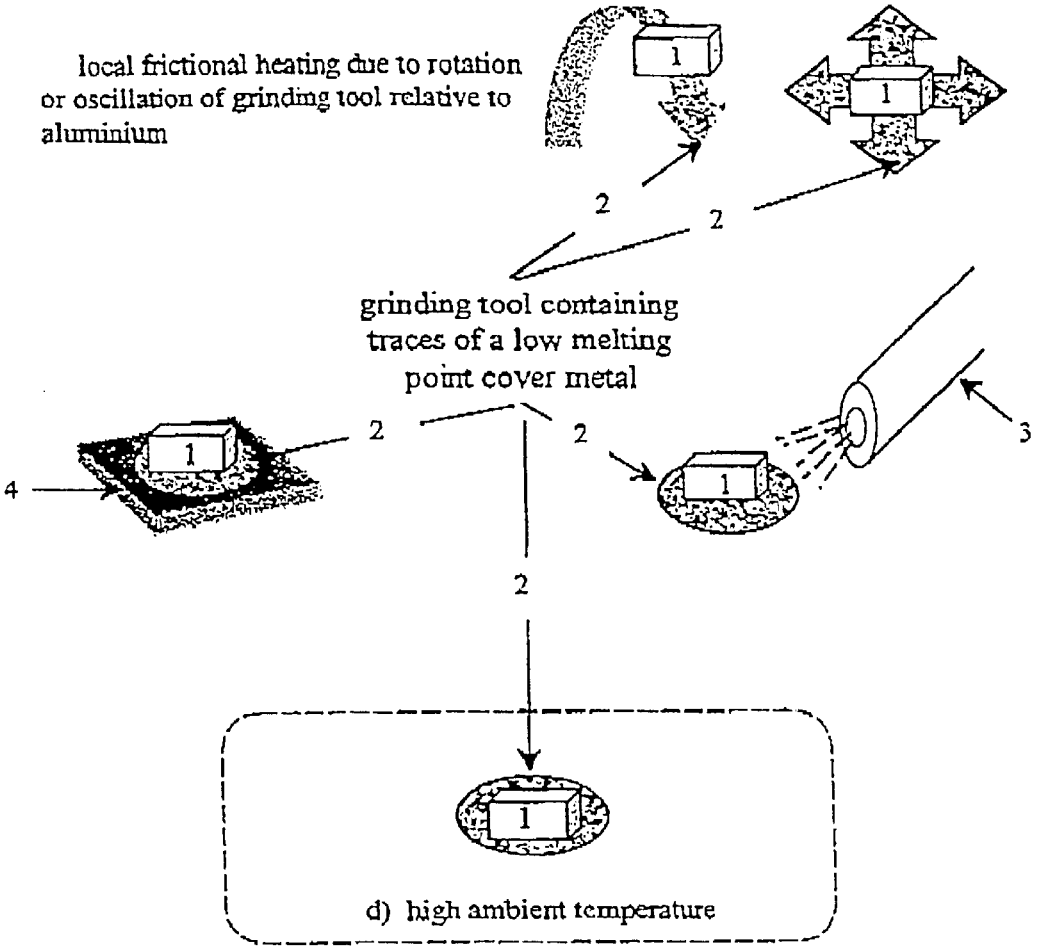

The present invention relates to the surface treatment of materials such as metallic alloys and composites that have a tendency to oxidise in air. Examples of such materials include Pe, Ni, Cr, Co, Ti, Li, Mg, Zn, Al based alloys and super alloys. Other example materials include metal-matrix composites, single crystals and directionally solidified alloys or super alloys. Such metallic alloys and composites oxidise readily because of the high chemical affinity of the metal for oxygen. This property has, for many years, been employed to particular advantage in that the almost instantaneous formation of oxide layers on the surfaces of such materials forms an excellent barrier to further oxidation. However, the almost instantaneous formation of the oxide layer can be a significant obstacle when wishing to join or coat such materials. For example, it is a major obstacle during diffusion bonding, brazing and electroplating, as well as when manufacturing electrical or electronic components, heat sinks, etc in which it is necessary to make good electrical and thermal contact with the substrate but such contact is hindered by the existence of the oxide layer.

Many different approaches to oxide layer removal have been suggested as removal of the oxide layer is a necessary step in many processes, such as the brazing of aluminium alloys. One approach to removal is to heat the aluminium-based material to a brazing temperature in the presence of a flux in order to remove the oxide layer. The flux is usually toxic and corrosive, and any excess may be removed after brazing, and typically is chloride or fluoride-based for aluminium alloys. Chemical treatment with an acid or alkaline simply results in the replacement of the aluminium oxide layer with various types of sulphides, nitrides, hydroxides, etc., rather than producing the desired oxide-free surface.

Another known method for the removal of the oxide surface is the use of ion beam cleaning in a vacuum, which must then be followed by in-situ sputter coating of another metal (such as copper or silver) on the clean surface to prevent re-oxidation when the surface is exposed to air. As will be appreciated, this approach is expensive, requires complex equipment and procedures, and therefore is of restricted use.

There have also been proposals to employ gallium in combination with aluminium for bonding or brazing soldering. For example, EP-A-0123382 proposes several different methods for bonding aluminium using gallium by rubbing molten gallium or an aluminium-gallium alloy directly on to the surface of aluminium or by employing chemical deposition by dipping aluminium in a solution of nitric acid containing gallium nitrate followed by lengthy heat treatment. There is also discussion in this document of electrochemical disposition using a gallium nitrate electrolyte. However, as has been known for a number of years, aluminium is attacked by molten gallium which then embrittles the aluminium to an extent that it can be damaged even by simple touch with a fingernail. So, this prior art document indicates that it is necessary to employ long bonding and/or heat treatment times (for example seventy to eighty hours) making the bonding a lengthy and impractical process.

In relation to brazing soldering, U.S. Pat. No. 2,824,365, for example, proposes the rubbing of gallium onto an aluminium surface in order to improve joint properties prior to soldering the aluminium by use of a lead-tin alloy. The detrimental effect of rubbing gallium is referred to in this prior art document to the extent that it is recommended to wipe off the crumbled surface of aluminium prior to soldering.

The present invention seeks to provide a method of oxide layer removal that overcomes the above problems.

According to the present invention there is provided a method for treating the surface of readily oxidisable material to remove an oxide layer formed thereon, the method comprising the step of:

grinding the surface of the material with a grinding or polishing device having a metal with a melting point of 300° C. or lower impregnated therein.

The readily oxidisable material may be one of iron, nickel, lithium chromium, cobalt, titanium, copper, magnesium, aluminium or zinc based alloy or super alloy, metal matrix composite, single crystal or directionally solidified alloy or super alloy.

The grinding or polishing device may be a rotating or oscillating grinding tool, may be a grinding brush, or may be a cloth or paper. The metal may be gallium, indium zinc, or mercury or their alloys. The method may further comprise the step of heating the surface of the base material as it is ground, although this is not always needed.

The present invention provides an end component which is protected from further oxidation by the impregnating metal layer that is formed through the grinding process, but as only a very thin layer is produced there are none of the problems associated with embrittling that occurs in the prior art referred to above.

An example of the present invention will now be provided with reference to the accompanying drawing, in which:

FIG. 1 is a schematic diagram showing the main steps of an example of the method of the present invention. In this, an aluminium-based material 1, such as pure aluminium, a metallic alloy thereof or a composite thereof, has a surface that is covered in an oxide layer but for which it is necessary to remove the oxide layer for use in one of the processes of the type discussed below. It will be appreciated that the material could, however, be one of the types listed above.

Accordingly, in order to remove the oxide layer the surface is ground by either moving the material 1 against a grinding surface 2 or vice-versa. The grinding surface 2 may be a rotating or oscillating grinding tool, appropriate emery paper, brush or polishing cloth. The exact tool which is used will depend upon the application. For example, if gallium is impregnated into the grinding surface then the local surface temperature will be 30° C. or higher, as the melting point of gallium is approximately 27° C. Equally, the material with which the grinding surface is impregnated will be dependent upon the application for which the material is to be employed in its end-use. The impregnating metal ideally should not be one which forms any undesirable components with the base aluminium, and copper, gallium, indium, zinc or mercury (or their alloys) are preferable options.

For example, gallium forms a liquid phase with pure aluminium at about 27° C., a practical temperature for performance of the method, without forming any intermetallic phase. This means that the amount of gallium required to interact with the surface and hence remove the oxide by forming an aluminium-gallium eutectic phase is sufficiently small that there is no embrittlement of the material 1.

During grinding, the surface of the material 1 may be heated by a heat gun 3, or by a hot plate 4, or alternatively by placing the whole apparatus, including the grinding surface, in a high ambient temperature environment. The manner of heating will be very much dependent upon the impregnating metal that is being employed as well as the size and type of the material to be coated and the grinding and polishing tool that is being used.

With the method of the present invention the grinding or polishing step operates to remove any oxide layer that is formed on the material 1 and, at the same time, before a replacement oxide layer can be formed, produces an extremely thin coating of the impregnating metal to produce a sealing layer that prevents oxide re-generation.

The method can be used, for example to prepare the surface of aluminium-based materials for a number of processes.

One such process is solid-state diffusion bonding. As an example, surfaces of aluminium-based alloys Al-6082, Al-6061, UL40(Al/4% Li) and pure aluminium were ground using heated emery paper (1200 grit) containing a small amount of gallium. After preparation the prepared surfaces were inserted into a diffusion bonding rig which was evacuated down to $10^{-4}$ mbar. The bonding was carried out at 550° C. under a pressure of about 5 MPa for a time of approximately thirty minutes. This produced reliable and high-strength solid state bonds. As a further example, satisfactory bonds have been prepared in such alloys by bonding in air or inert atmosphere rather than vacuum.

The method of the invention can also be used to prepare surfaces for flux-free brazing, soldering and liquid-phase diffusion bonding.

Prior to the invention, soldering of aluminium alloys, using for example zinc-based low-temperature soldering alloys, has required the aluminium-based material surface to be abraded whilst the solder is applied so that the oxide layer is mechanically disrupted and broken up. This abrading is not required with a surface prepared in accordance with the method of the invention. Here a surface prepared in accordance with the present invention allows a solder alloy to wet the surface and hence allows the formation of metallic bonds between the oxide-free surface and the solder. Similarly, liquid-phase diffusion bonding processes, for example using interlayers such as zinc, copper or silver, benefit from the surfaces prepared in accordance with the invention. It also enables easier bonding of similar or dissimilar alloys, composites and ceramics to the oxidisable material.

Also, using this invention, high quality bonds in nickel based super alloys, including directionally solidified and single crystals, have been produced.

A further application of this invention is the manufacturing of emery papers, brushes or cloths impregnated with the low melting point metal(s) and which can be used to prepare the surfaces of the aluminium-based materials being joined.

As mentioned above, the present invention can also be used to prepare electrical and electronic components so that they have connecting components which are substantially free of an oxide surface improving electrical and thermal conductivity of the components.

A further application for materials prepared in accordance with the invention is that of electroplating. With the present invention, a material prepared in accordance with the invention has a conductive metallic surface which enables it to be electroplated.

What is claimed:

1. A method for treating the surface of readily oxidisable material to remove an oxide layer formed thereon, the method comprising the step of:

grading the surface of the material with a grinding or polishing device having a metal with a melting point of 300° or lower impregnated therein.

2. The method of claim 1 wherein the grinding tool or polishing device is one of a rotating or oscillating grinding tool, a grinding brush, a cloth, or paper.

3. The method of claim 1, wherein the metal is one of gallium, indium, zinc, or mercury or their alloys.

4. The method of claim 1 further comprising the step of heating the surface of the oxidisable material as it is ground.

5. The method of claim 1, wherein the readily oxidisable material is one from the group of:

iron, nickel, lithium, chromium, cobalt, titanium, copper, magnesium, aluminum or zinc based alloy or super alloy, metal matrix composite, single crystal or directionally solidified alloy or super alloy.

* * * * *